US007416442B1

(12) United States Patent
Liu

(10) Patent No.: US 7,416,442 B1
(45) Date of Patent: Aug. 26, 2008

(54) CONNECTOR

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 11/889,690

(22) Filed: Aug. 15, 2007

(51) Int. Cl.
*H01R 13/60* (2006.01)

(52) U.S. Cl. ..... 439/540.1; 439/607; 439/620.18; 439/620.19

(58) Field of Classification Search ..... 439/540.1, 439/490, 607, 608, 620.18, 620.19, 676
See application file for complete search history.

(56) References Cited

U.S. PATENT DOCUMENTS 6,080,011 A * 6/2000 Tsao et al. ..... 439/541.5
6,984,155 B1 * 1/2006 Liu ..... 439/676
7,044,779 B1 * 5/2006 Liu ..... 439/541.5
7,052,315 B2 * 5/2006 Murr et al. ..... 439/540.1

* cited by examiner

*Primary Examiner*—Phuong K Dinh
(74) *Attorney, Agent, or Firm*—Bacon & Thomas, PLLC

(57) ABSTRACT

A connector has a combination of a terminal set and a back cover together disposed inside a shell, where the shell and the back cover are further covered by a metal mask. The terminal set consists of at least one connecting port. The connecting port includes a circuit board and a hollow pin base disposed on the circuit board. The front side wall of the pin base is formed with a grating part so that the hollow part of the pin base has a larger space to accommodate electronic devices. A ground window is formed on the back cover so that the ground node of the circuit board is directly exposed. The metal mask is thus directly in touch with the ground node to simply the assembly process of the connector.

10 Claims, 10 Drawing Sheets

CONNECTOR

BACKGROUND OF THE INVENTION

1. Field of the Invention

The invention relates to a connector and particularly to the RJ45 and RJ11 connectors.

2. Description of Related Art

The manufacturing technology of electrical connectors has been very mature. There is very limited space to improve, in either their structures or circuits, due to the required specifications of various connectors. Under the specifications, each electrical connector has a specific size. However, a certain amount of electronic devices are needed in a space, how to efficiently make use of the space to accommodate more and larger electronic devices is an important issue of the field.

The outermost layer of normal electrical connectors is usually provided with a metal mask. The metal mask is connected to the ground of the circuit board associated with the connector to provide required shielding. Such shielding prevents or lowers the interference from electromagnetic waves or other noises, ensuring better quality in the transmitted signals. However, the method of grounding the metal mask in the prior art is rather involved. One or several hidden wires are connected to the metal mask. The other end(s) of the hidden wire(s) is (are) then connected to a ground node on the circuit board mounted inside the connector. The wire(s) is (are) hidden under the metal mask. The process for preparing such wires is very time-consuming and complicated, whether using an automatic machine or manually. Therefore, it is necessary to improve for a better efficiency.

SUMMARY OF THE INVENTION

In view of the facts that the limited internal space of connectors restrict the number and size of electronic devices therein and that the grounding process of the metal mask is involved and time-consuming, the invention provides a solution.

The disclosed connector includes a terminal set, a back cover, an outer shell, and a metal mask.

The terminal set includes at least one connecting port having a terminal base with several signal terminals, a pin base with several pins, and a circuit board with several electronic devices thereon. The pin base is disposed on the circuit board and consists of a hollow, rectangular, closed body. A sheet body protrudes from the front side of the body to form a grating part corresponding to the signal terminals. The signal terminals and the pins are connected to the circuit board.

The back cover includes a bottom board and a back board extended vertically upward from the back edge of the bottom board. The connecting side of the bottom board and the back board is formed with several ground windows. Several holes are formed on the bottom board for the pins of the terminal set to go through.

The outer shell includes a front board, a top board, and two side boards connecting the corresponding sides of the top board and the front board. The front board is formed with several openings corresponding to the connecting ports. The terminal set and the back cover are combined side the outer shell.

The metal mask covers the outer shell surface and the back board of the back cover. In particular, the metal mask is formed with several ground conductive plates that are in touch with the ground node of the circuit board via the ground windows.

By forming the grating part on the front side of the pin base, there is more room inside the pin base for accommodating more electronic devices. Moreover, the ground conductive plates of the metal mask are in electrical contact with the ground node of the circuit board via the ground windows, the metal mask can be readily connected to the ground by simple soldering. The assembly of the connector becomes much faster.

DETAILED DESCRIPTION OF THE PREFERRED EMBODIMENT

Figure 1:
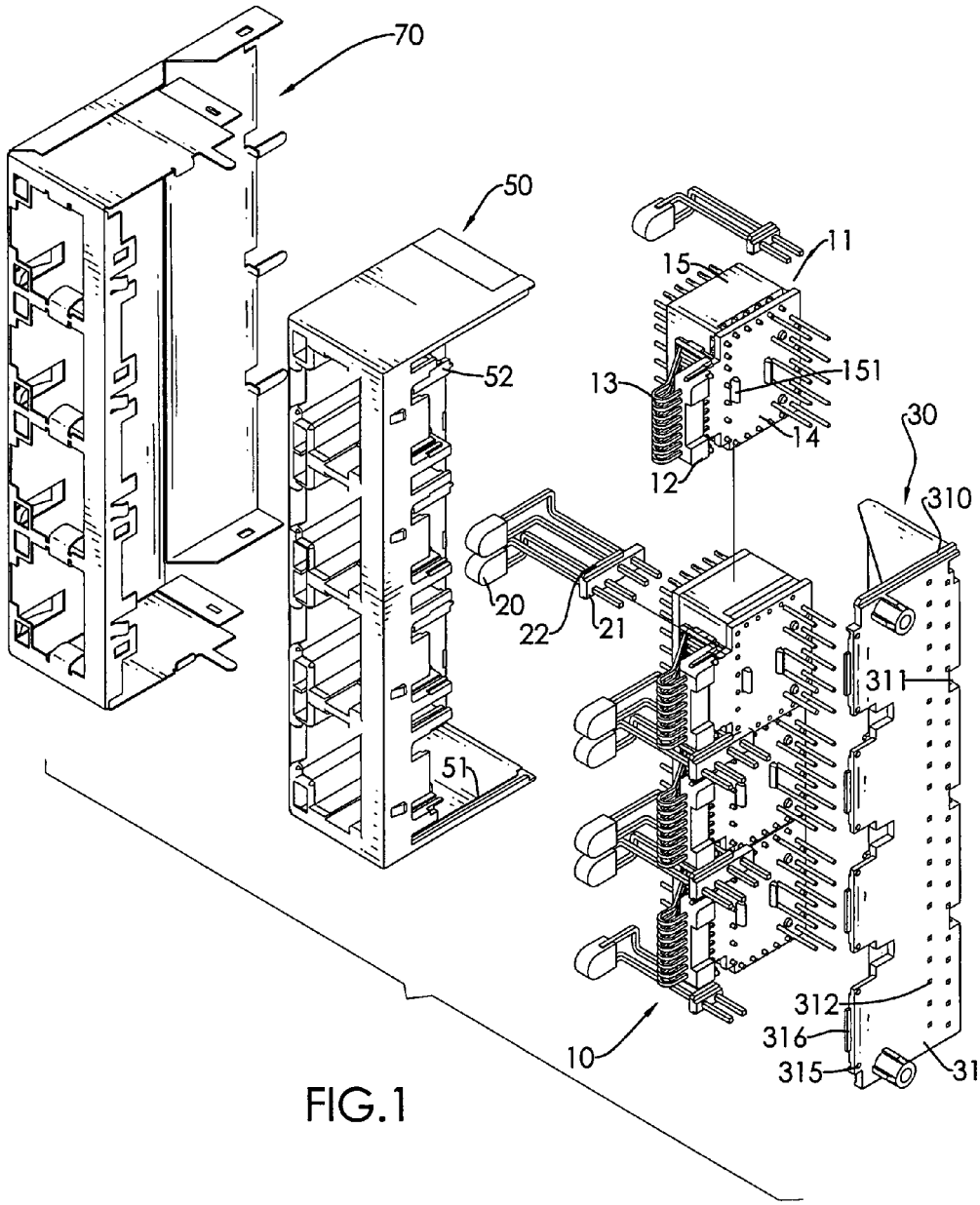
FIG. 1 is an exploded view of a connector in accordance with the present invention.

As shown in FIG. 1, the connector includes a terminal set 10, a back cover 30, an outer shell 50 made of an insulating material, and a metal mask 70. The structures of the components and their assembly are described in detail as follows.

Figure 2:
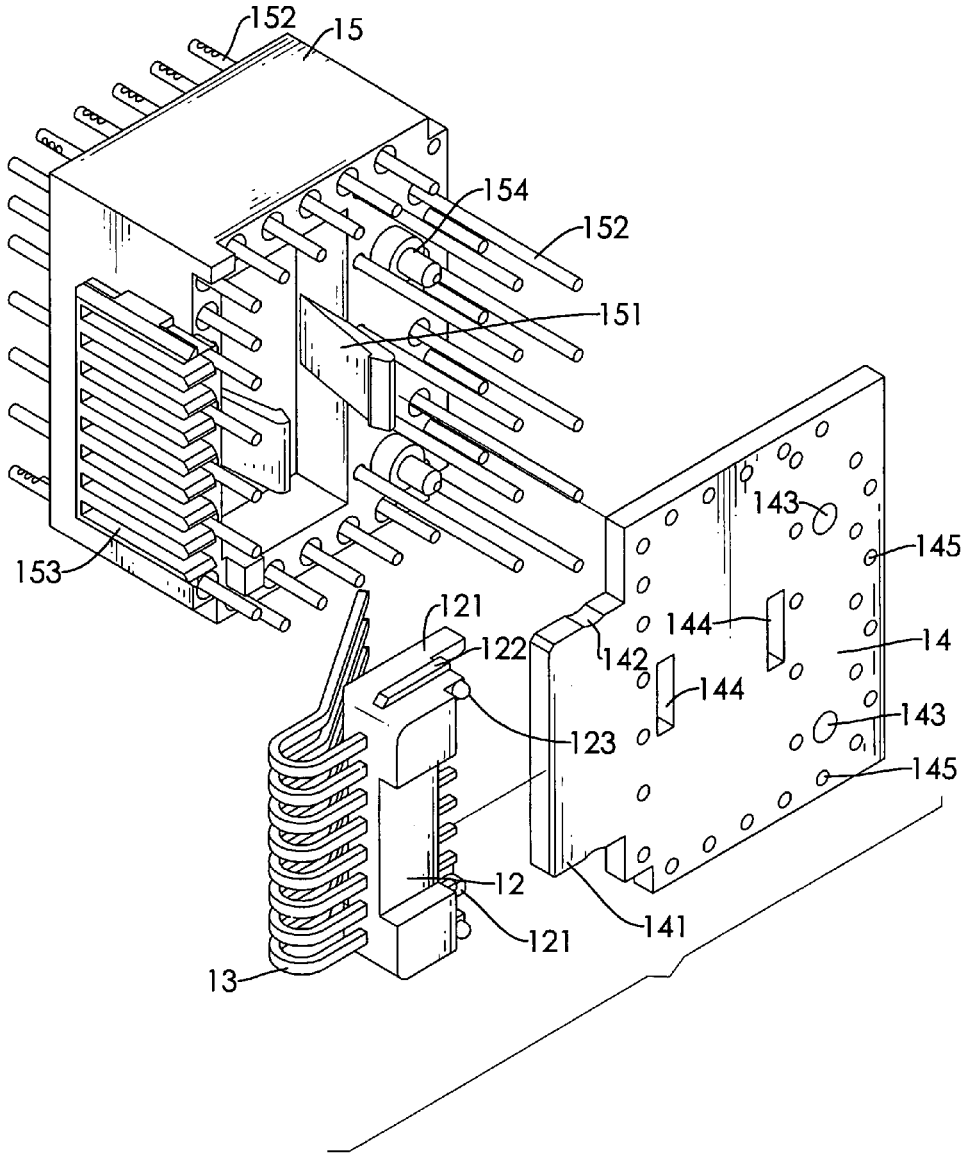
FIG. 2 is an exploded view of a single connecting port of FIG. 1.
Figure 3:
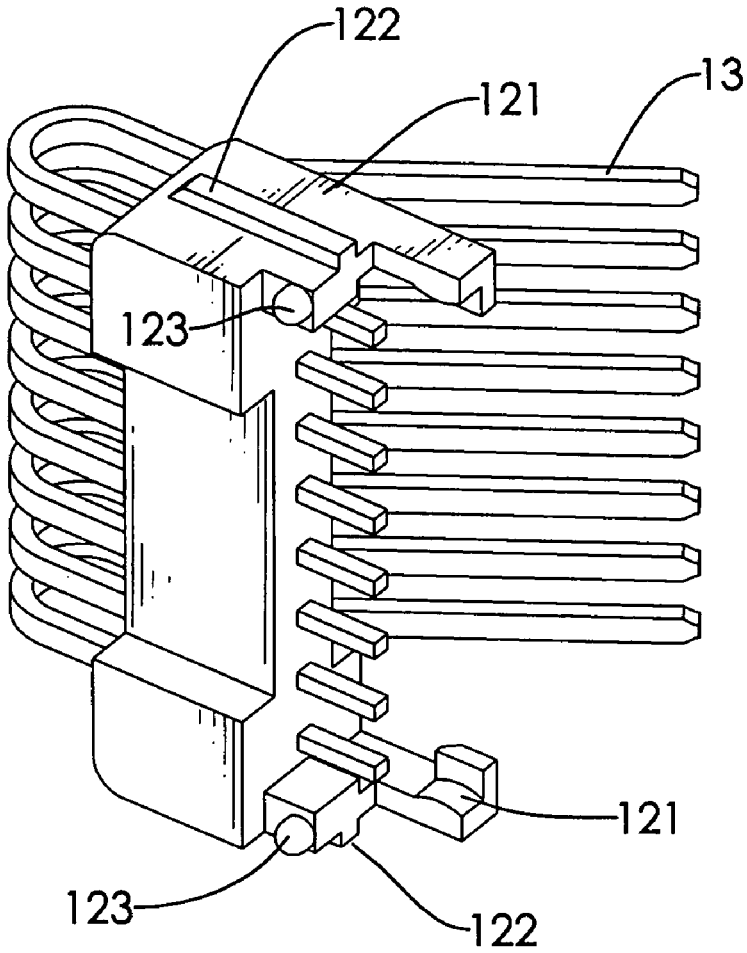
FIG. 3 is a perspective view of the terminal base of FIG. 2.

First, the terminal set 10 consists of at least one connecting port 11. In this embodiment, there are four connecting ports 11 disposed in a line. The detailed structure of each connecting port 11 is given in FIGS. 2 and 3. Each connecting port 11 includes a terminal base 12, multiple signal terminals 13 penetrating through the terminal base 12, a circuit board 14 and a pin base 15.

The circuit board 14 has a rectangular substrate with a front edge from which a connecting part 141 protrudes. Each of the opposite sides of the connecting part 141 is formed with a notch 142. The circuit board 14 is formed with positioning holes 143, hook holes 144 and pin holes 145 through the circuit board 14.

The terminal base 12 is formed with a row of through holes so that the horizontal part of each signal terminal 13 can be inserted therein. A hook arm 121 extends from each side of the terminal base 12. The two hook arms 121 hold the notches 142 on the connecting part 141 of the circuit board 14. After the terminal base 12 is combined with the circuit board 14, the signal terminals 13 touch against corresponding nodes (not shown) formed on the bottom surface of the circuit board 14. The signal terminals 13 are further electrically connected to the circuit board 14 by soldering. Moreover, a longitudinal rib 122 protrudes from each of the opposite sides of the terminal base 12. A protruding block 123 is formed on the bottom surface of the terminal base 12 near the two opposite sides.

The pin base 15 is a closed rectangular body. The inside of the rectangular body forms an accommodating space for electronic devices such as the transformer, filter capacitor, resistor, etc. The above-mentioned electronic devices are connected to the top surface of the circuit board 14. A hook 151 is formed on each of two opposite side walls of the accommodating space. The pin base 15 allows multiple pins 152 to extend through and be fixed thereon. A sheet body with an appropriate thickness protrudes from the front side surface of the pin base 15. The sheet body forms a grating structure 153 having several slits. Two positioning posts 154 are further extended from the bottom surface of the pin base 15.

After the pin base 15 combines the terminal base 12 and the circuit board 14, the signal terminals 13 extend through the slits of the grating structure 153 respectively. The two hooks 151 extend through the hook holes 144 and touch against the bottom surface of the circuit board 14. The two positioning posts 154 are inserted correspondingly into the positioning holes 143 to ensure the correct connection. The pins 152 on the pin base 15 are connected to the circuit board 14. Some of the pins 152 even go through the circuit board 14 for a possible connection to an application circuit board (e.g., the motherboard in a computer).

Figure 4:
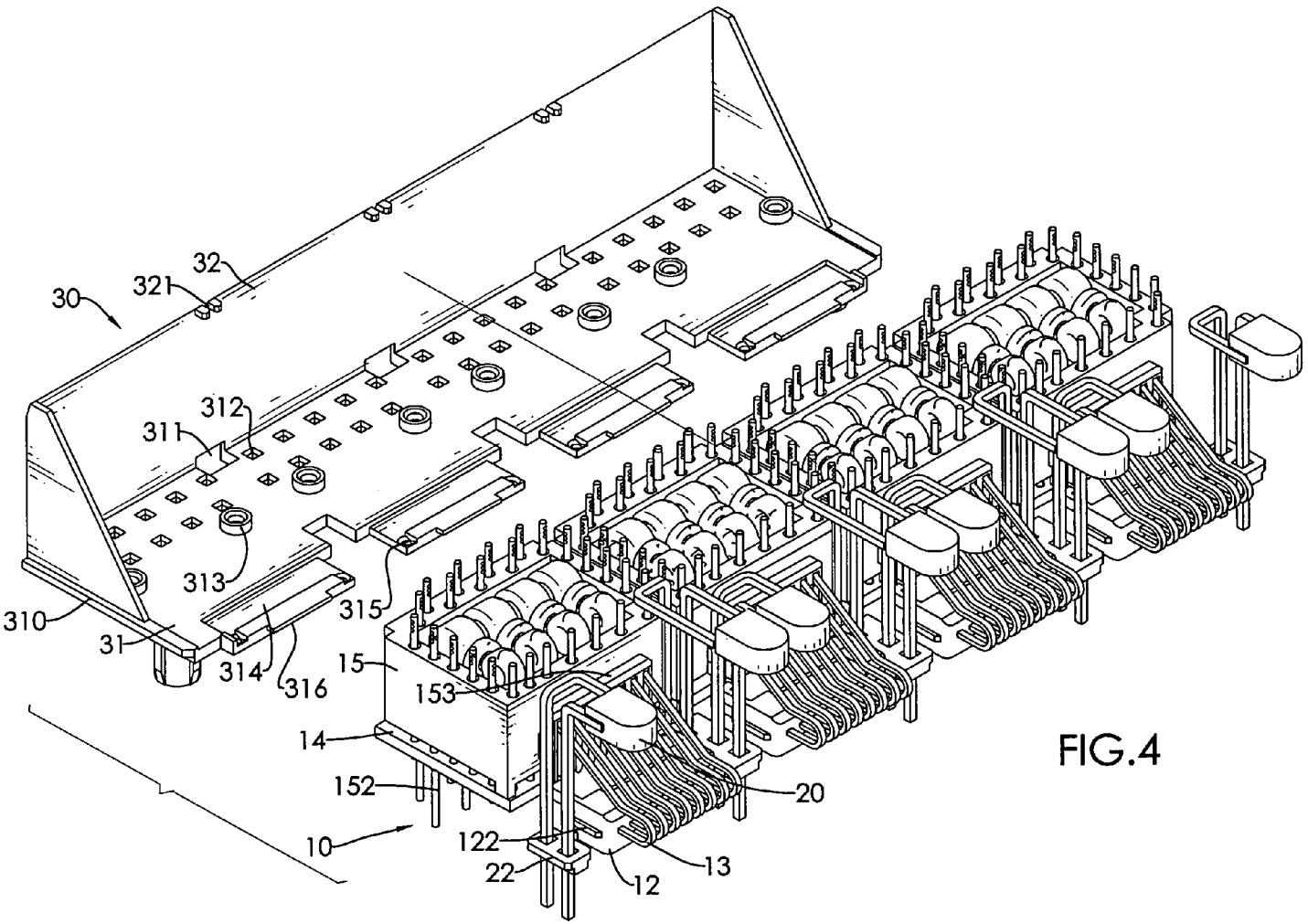
FIG. 4 is an exploded view of the assembled terminal set and back cover of FIG. 1.
Figure 5:
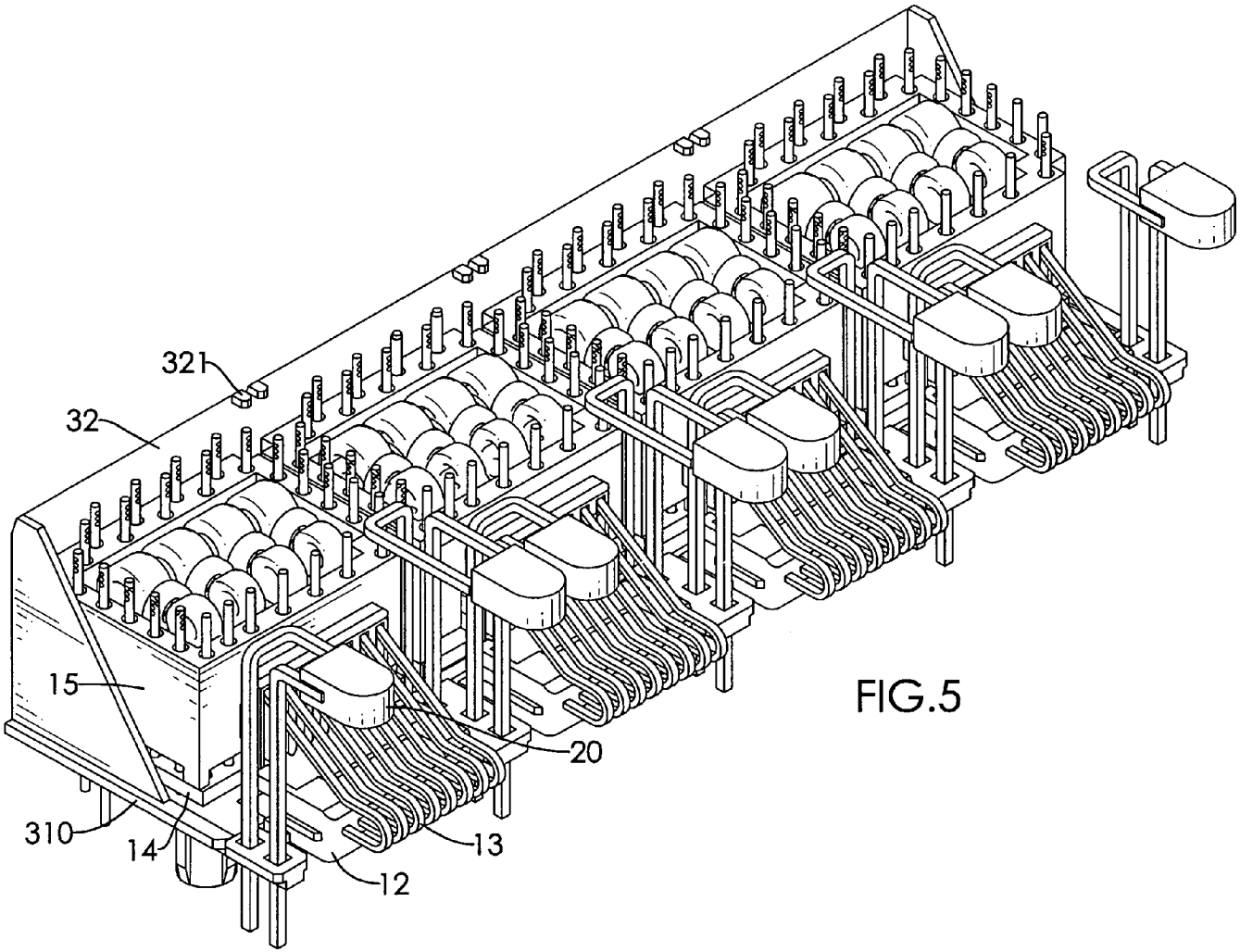
FIG. 5 is a perspective view of the terminal set and the back cover assembled together.

With further reference to FIGS. 1, 4, and 5, after several connecting ports 11 are disposed in a line and connected to form the terminal set 10, an LED indicator 20 is provided between each two adjacent connecting ports. Only one LED indicator 20 is provided on both sides of the terminal set 10. The LED indicators 20 are fixed on an LED substrate 21, which has a side strip 22 formed on one side of the LED substrate 21. The terminal set 10 and the LED indicators 20 are further mounted to the back cover 30. The back cover 30 includes a bottom board 31 and a back board vertically extended from a back edge of the bottom board 31. Each of the two sides of the bottom board 31 is formed with a sliding rib 310. A connecting junction where the bottom board 31 and the back board 32 join together is formed with several ground windows 311 separated at equal distances. Each ground window 311 is defined through both the back board 32 and the bottom board 31.

The bottom board 31 is formed with multiple holes 312 corresponding to the pins 152 for them to penetrate through the back cover 30. Multiple concave bases 313 are formed on the bottom board 31 corresponding to the positioning posts 154. The concave bases 313 do not penetrate through the bottom board 31, but can accommodate the positioning posts 154. Several platform parts 314 extend from a front edge of the bottom board 31. Two ends of each platform part 314 are formed with two circular holes 315 respectively. After the terminal set 10 is mounted to the back cover 30, the protruding block 123 at the bottom of the terminal base 12 falls into the circular hole 315 for positioning. The front end of the platform part 314 further has a protruding edge 316. The upper edge of the back board 32 is formed with multiple supporting blocks 321. A tiny gap exists between each two adjacent supporting blocks 321. The supporting blocks 321 extend horizontally toward the inside, i.e., the terminal set 10.

Figure 6:
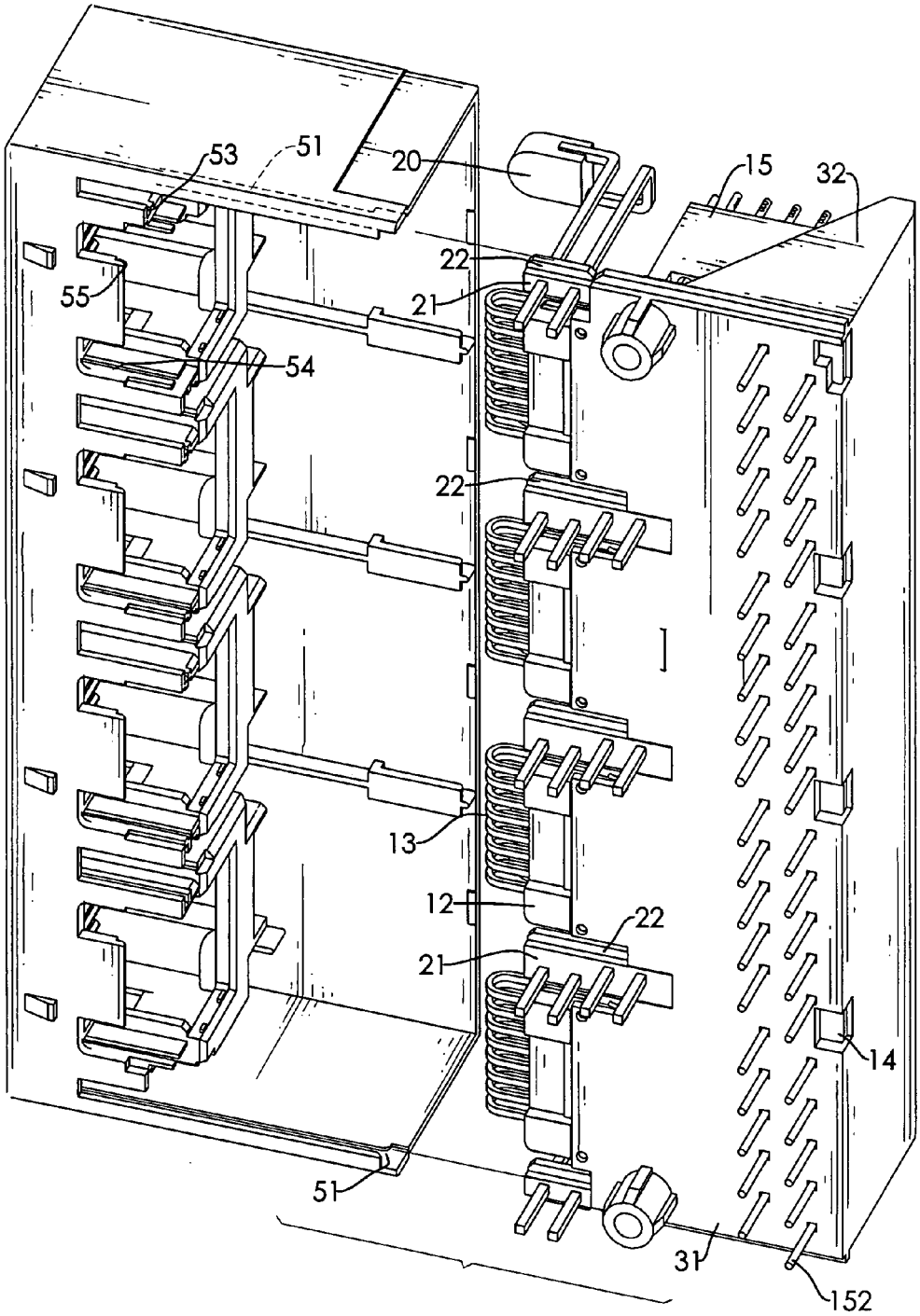
FIG. 6 is a perspective view of the combined terminal set and back cover separated from the outer shell.

As shown in FIG. 6, after the terminal set 10 is mounted to the back cover 30, the bottom surface of the circuit board 14 is partially exposed through the ground windows 311. The exposed bottom area of the circuit board 14 is used for the ground connection of the metal mask 70. This will be further described later.

The assembled terminal set 10 and the back cover 30 is disposed in the outer shell 50. The outer shell 50 is made of insulating plastic. The outer shell 50 includes a front board, a top board, and two side boards connected to opposite sides of the top board. The front board of the outer shell 50 is formed with several openings corresponding to the connecting ports 11. A groove 51 is formed on an inner surface of each side board for the sliding ribs 310 formed on both sides of the back cover 30 to slide therein, thereby mounting the back cover 30 to the outer shell 50. Afterwards, the supporting blocks 321 on the upper edge of the back board 32 are located on a frame part 52 formed in the outer shell 50. The supporting force provided by the frame part 52 can avoid vertical displacement of the back cover 30 and the outer shell 50.

Multiple recesses 53, 54 are formed on the sidewall of each opening of the outer shell 50. The recesses 53, 54 are used for the connection of the side strip 22 of the LED substrate 21 and the protruding ribs 122 on both sides of the terminal base 12. A ladder part 55 is formed on the bottom surface of each opening inward. The ladder part 55 corresponds to each protruding edge 316.

Figure 7:
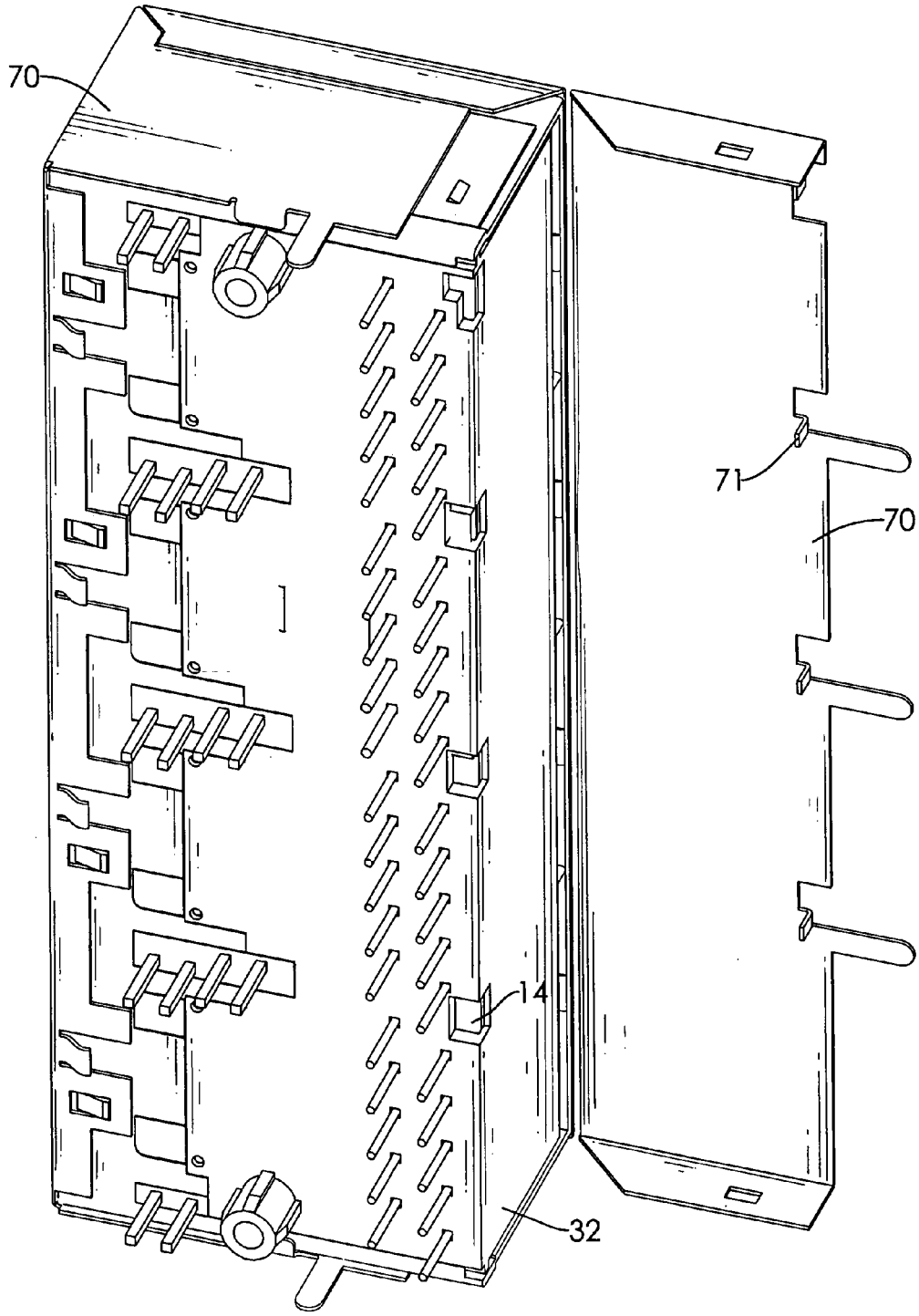
FIG. 7 is a perspective view of the connector.
Figure 8:
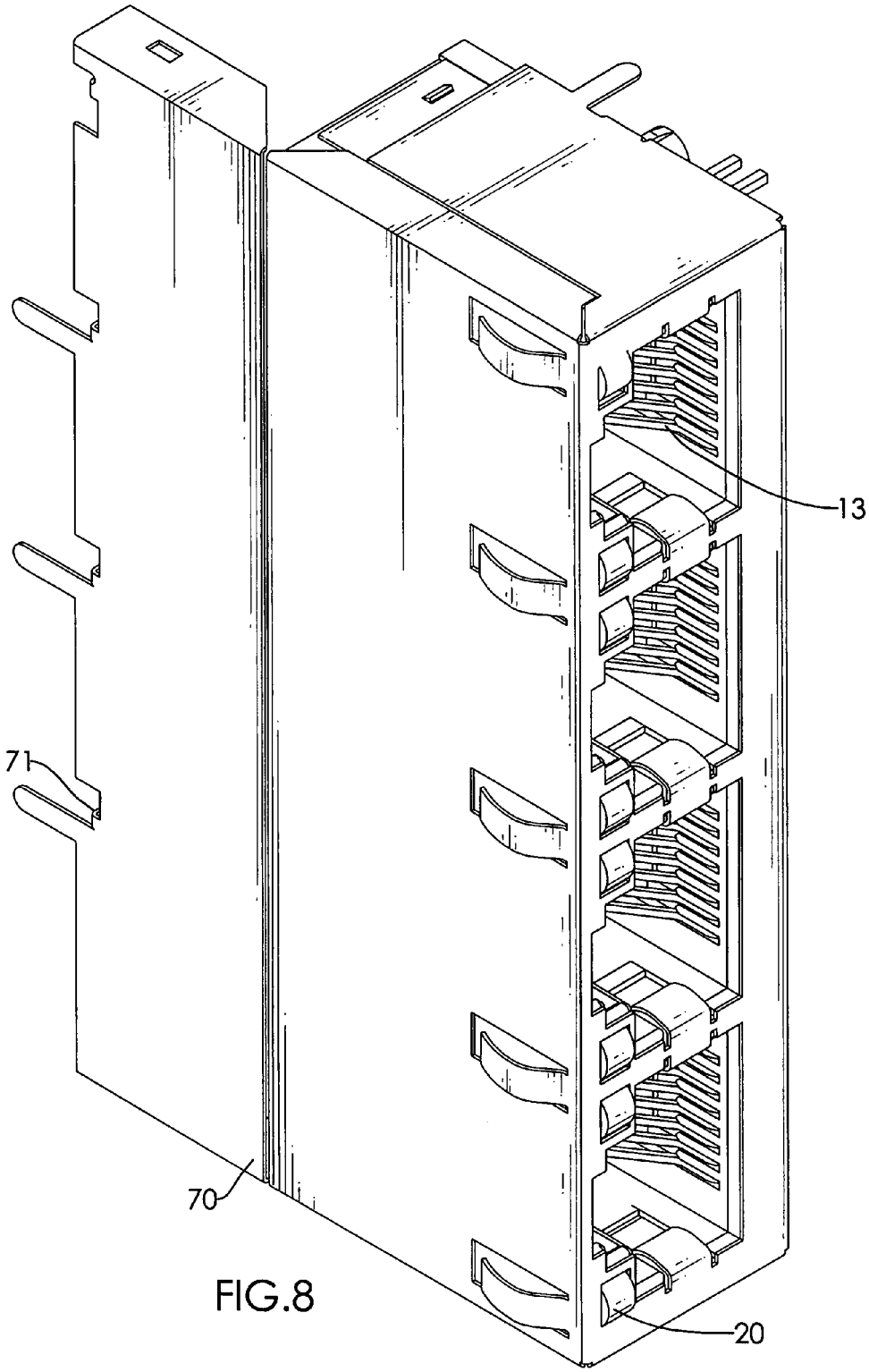
FIG. 8 is another perspective view of the connector.
Figure 9:
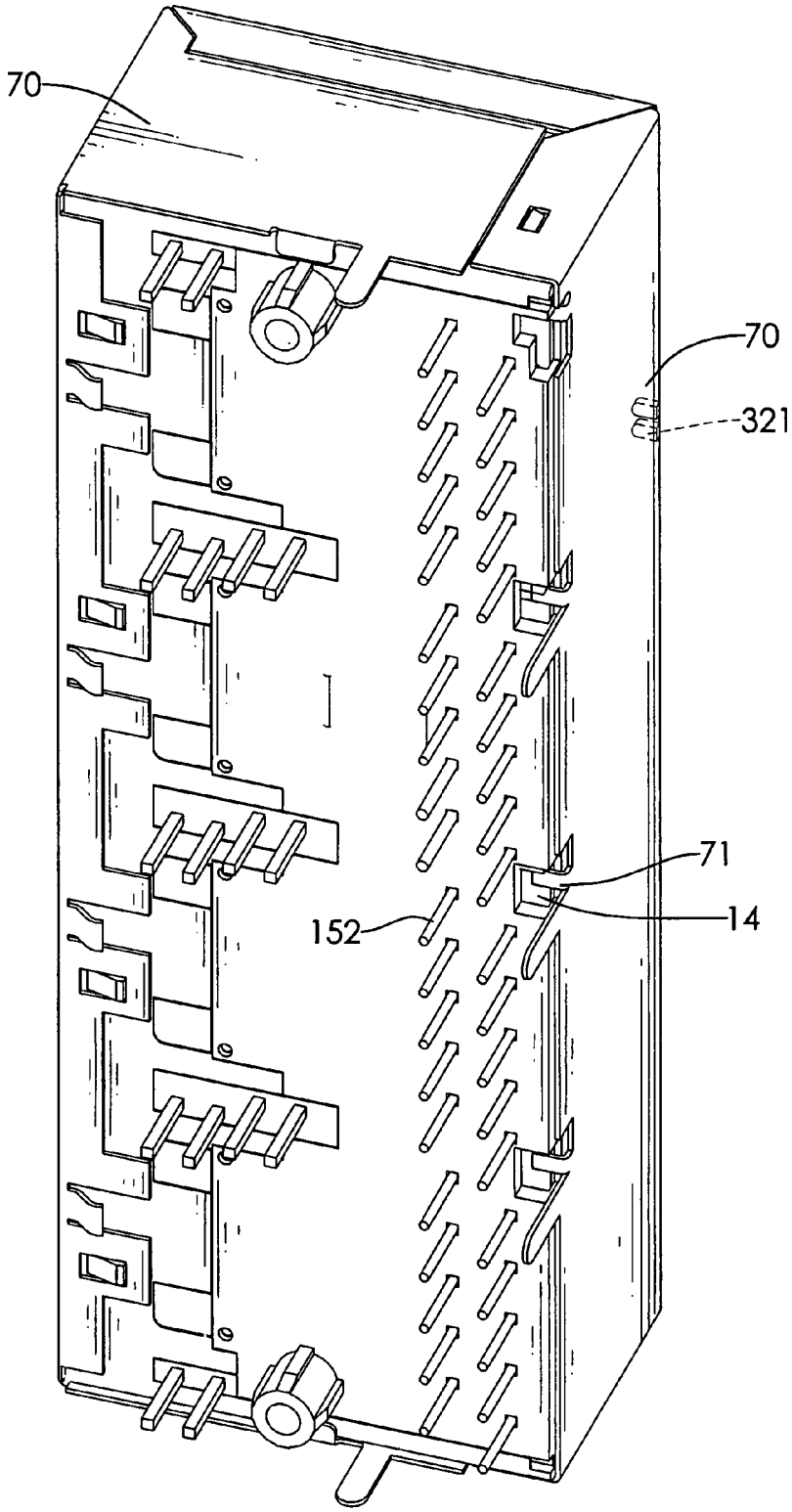
FIG. 9 is yet another perspective view of the connector.

With further reference to FIGS. 7 to 9, when the terminal set 10, the back cover 30 and the outer shell 50 are assembled together, the outermost surface is covered with the metal mask 70. The metal mask 70 is a single metal sheet. The sheet can appropriately bent to cover the front, top, left, and right sides of the outer shell 50, as well as the back board 32 of the back cover 30. The edge of the region of the metal mask 70 that covers the back board 32 is bent to form several ground conductive pins 71. The ground conductive pins 71 are in touch with the ground nodes on the bottom surface of the circuit board 14 via the ground windows 311. To ensure good electrical contact between the ground conductive pins 71 and the ground nodes, a soldering process is employed to connect them. Thus, the metal mask 70 can provide the necessary shielding effect.

Figure 10:
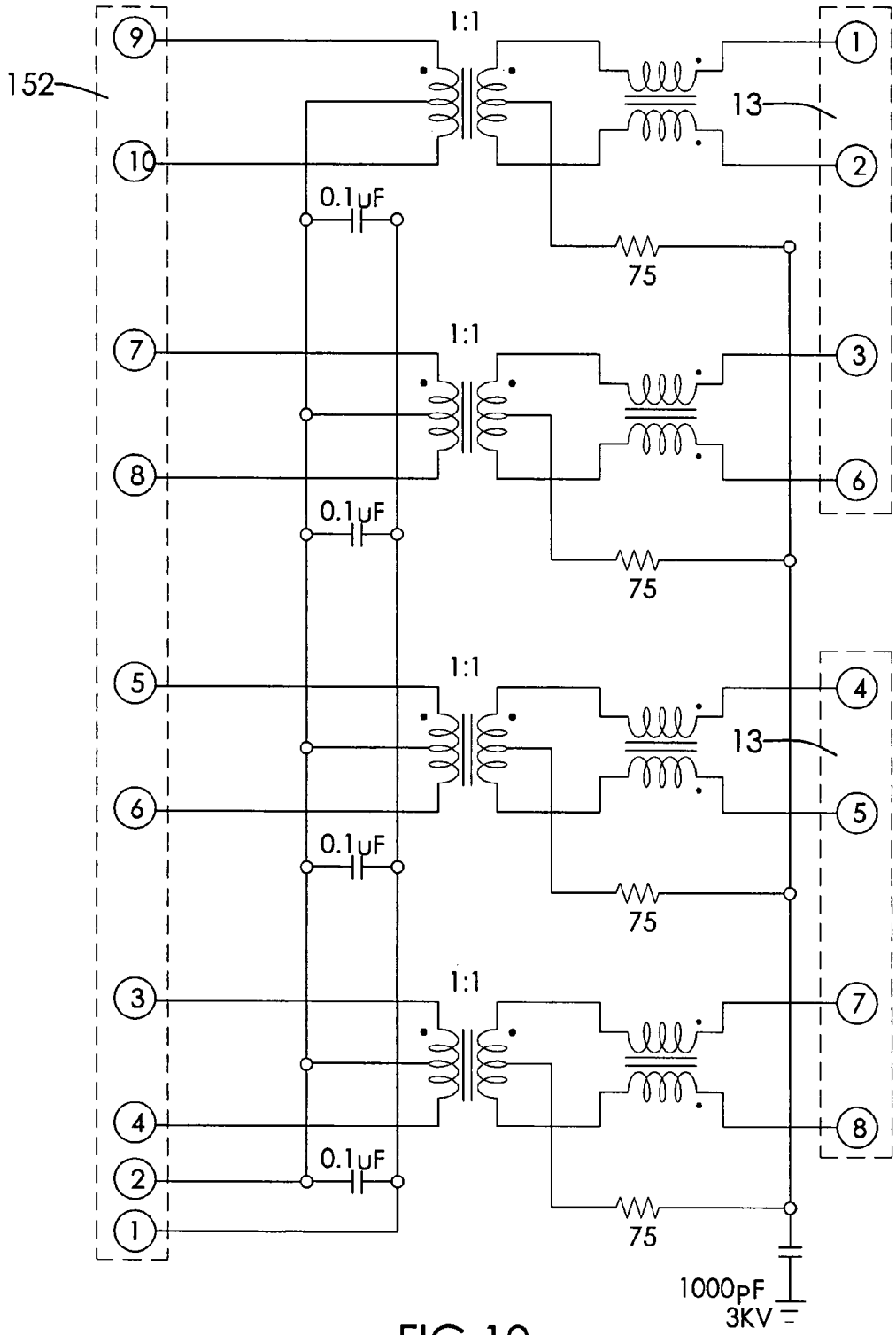
FIG. 10 shows an embodiment of the circuit inside the connector.

FIG. 10 is a circuit diagram showing the connection between the electronic devices on the circuit board 14 and the signal terminals 13 and pins 152. Take an RJ45 connector as an example, there are eight signal terminals 13. The eight signal terminals 13 are paired to connect to one side of a first transformer. The other side of the first transformer is connected with a second transformer. The other side of the second transformer is connected with the corresponding pins 152. The second transformer is first connected with a resistor in series and then connected to a ground terminal via a capacitor. The ground terminal is connected to the metal mask 70. The LED indicators 20 are serially connected with an external current-limiting resistor on the circuit board 14 for protection. They can also be the LED indicators 20 that have already been integrated with the current-limiting resistor.

According to the above-mentioned structure and connection method, the disclosed connector can have more space inside the pin base to accommodate more active/passive electronic devices (e.g., filter transformer, filter capacitor, etc). This is achieved by moving the grating structure out to protrude from the front side of the pin base. The back cover is formed with ground windows to directly expose the ground nodes. The ground conductive plates on the metal mask are in electrical contact with the ground nodes in order to provide simple grounding of the metal mask. This does not involve any complicated process or additional wire connections. The connector assembling processes thus have superior efficiency.

What is claimed is:

1. A connector comprising:

a terminal set comprising at least one connecting port having a circuit board with electronic devices mounted on the circuit board;

a terminal base connected to the circuit board and penetrated through by multiple signal terminals connected to the circuit board; and a pin base being a hollow, rectangular, closed body mounted on the circuit board, penetrated through by multiple pins and having a front side; and a sheet body protruding from the front side of the body to form a grating structure corresponding to the signal terminals;

a back cover attached to the terminal set and comprising a bottom board having a back edge;

a back board extending vertically from the back edge of the bottom board;

multiple ground windows defined through the bottom board and the back board and located at a junction where the bottom board and the back board are jointed together; and multiple holes defined through the bottom board for the pins of the terminal set to extend through the back cover;

an outer shell assembled with the terminal set and the back cover and comprising a top board with two opposite edges;

a front board having at least one opening corresponding to the at least one connecting ports; and two side boards connected to the front board and the opposite edges of the top board, wherein the terminal set and the back cover are combined and accommodated inside the outer shell; and a metal mask covering the outer shell and the back board of the back cover, and having multiple ground conductive pins to electrically contact with ground nodes on the circuit board through the ground windows.

2. The connector as claimed in claim 1, wherein the circuit board of the connecting port comprises a rectangular substrate having a front edge;

a connecting part extending from the front edge of a rectangular substrate and having two opposite sides;

two notches formed respectively on the two opposite sides of the connecting part; and the terminal base having two opposite sides on which two hook arms are formed respectively for engaging the notches of the connecting part.

3. The connector as claimed in claim 2, wherein the circuit board further comprises positioning holes, hook holes and pin holes defined through the rectangular substrate;

the body of the pin base extends two hooks and positioning posts to correspond to the hook holes and the positioning posts; and the pins of the pin base penetrating through the pin holes of the circuit board.

4. The connector as claimed in claim 3, wherein the bottom board of the back cover is formed with multiple recesses for receiving the positioning posts on the circuit board.

5. The connector as claimed in claim 4, wherein an upper edge of the back board is formed with a supporting block and an inner surface of the top board of the outer shell is formed with a frame part to correspondingly support the supporting block.

6. The connector as claimed in claim 5, wherein an front edge of the bottom board of the back cover extends a platform part, both sides of the platform part are formed with a circular hole and the front side of the platform forms a protruding edge, and a bottom surface of the terminal base is formed with protruding blocks corresponding to the circular holes.

7. The connector as claimed in claim 6, wherein the terminal set further includes LED indicators disposed on an LED substrate and the LED indicators are disposed on both sides of the connecting port.

8. The connector as claimed in claim 7, wherein both sides of the back cover are formed with a sliding rib, both sides of the terminal base are formed with a protruding rib, both sides of the LED substrate are formed with a side strip, and the outer shell is formed with grooves and recesses for holding the sliding ribs, the protruding ribs and the side strips.

9. The connector as claimed in claim 6, wherein the outer shell is formed with a ladder part corresponding to the protruding edge.

10. The connector as claimed in claim 6, wherein the ground conductive plates of the metal mask are connected to the ground nodes on the circuit board by soldering.

* * * * *